United States Patent [19]

Jonas

[11] 4,265,441

[45] May 5, 1981

[54] SHEET DISPENSING DEVICE FOR USE WITH COPYING MACHINES, AND A CONTAINER FOR THE STACK OF SHEETS

[75] Inventor: Walter K. Jonas, Neuss, Fed. Rep. of Germany

[73] Assignee: Minnesota Mining and Manufacturing Company, St. Paul, Minn.

[21] Appl. No.: 77,672

[22] Filed: Sep. 21, 1979

Related U.S. Application Data

[62] Division of Ser. No. 865,942, Dec. 30, 1977.

[51] Int. Cl.[3] ..... B65H 3/30

[52] U.S. Cl. ..... 271/19; 271/42; 271/164

[58] Field of Search ..... 271/19, 20, 21, 22, 271/23, 24, 25, 162, 164, 42

[56] References Cited

U.S. PATENT DOCUMENTS

| | | | |
|---|---|---|---|
| 3,323,790 | 6/1967 | Pankow . | |
| 3,497,206 | 2/1970 | Tippy | 271/21 |
| 3,580,791 | 5/1971 | Jordan . | |
| 3,767,188 | 10/1973 | Rosenberg . | |
| 3,977,666 | 8/1976 | Suzuki | 271/164 X |
| 4,037,953 | 7/1977 | Sone | 271/164 X |

*Primary Examiner*—Richard A. Schacher

*Attorney, Agent, or Firm*—Cruzan Alexander; Donald M. Sell; John C. Barnes

[57] ABSTRACT

A sheet dispensing device having a pair of lateral guides defining a space within a housing for insertion of a container containing a stack of sheets. The dispensing device comprises a conveyor, which is reciprocated within the housing to carry the uppermost sheet from the container and dispense the same from the device, and a separator designed to retain all sheets with the exception of the uppermost sheet in the container. The dispensing of a sheet operates a switch to then energize the copying machine. The container has a pair of laterally extending flange-like members to engage laterally spaced guides in the housing and is perforated along two sides on the upper surface to permit removal of a section of the container to expose the uppermost sheets.

13 Claims, 8 Drawing Figures

SHEET DISPENSING DEVICE FOR USE WITH COPYING MACHINES, AND A CONTAINER FOR THE STACK OF SHEETS

This is a division of application Ser. No. 865,942 filed Dec. 30, 1977.

BACKGROUND OF THE INVENTION

1. Field of the Invention

This invention relates to a sheet dispensing device adapted for use with copying machines and the like, and in one aspect to a dispensing device which is operated manually to dispense the sheet and actuate the copy machine. The invention includes a novel container for holding the sheets within the dispensing device, making it easy to refill the dispensing device.

BRIEF DESCRIPTION OF THE INVENTION

The invention relates to a sheet dispensing device in particular for use with copying machines, comprising a space defined inside a housing by lateral guides for inserting a container containing a stack of sheets, which container is open at one of its end faces as well as at least at a portion of its surface extending parallel with respect to the sheets, the device further comprising a conveyor designed to take along the uppermost sheet, and a separator designed to retain all sheets with the exception of the uppermost sheet, wherein the conveyor and separator can be raised and lowered for adaptation to the height of the stack of sheets. Sheet dispensing devices of this kind can be used in addition to their use with copying machines for instance also with microfilm apparatuses, daylight projectors and other apparatuses which use up or use sheets, films or the like, which are fed individually from a stack.

The invention relates furthermore to a container for such a sheet dispensing device from which one end face and an adjacent portion of the upper side parallel with respect to the sheets and corresponding at least to the space needed for the conveyor and the separator may be removed. The container may for example be made of carton board, wherein removing the end face and the portion adjacent thereto of the upper side is effected readily by tearing it off, and the container is discarded when its content has been used up. The container may be designed also for repeated use and manufactured then for instance of plastics or sheet material. In this case, its one end face and the portion adjacent thereto of its upper side may be connected to the main portion of the container by means of a tear-open or tear-off strip for example. It is essential that the container in its closed condition protects the stack of sheets contained in it against damage being caused e.g., by light or moisture, and that when the container is opened and inserted into the sheet dispensing device the stack of sheets and the separator can cooperate and the uppermost sheet can in each case be gripped by the conveyor.

It is therefore an object of the invention to design a sheet dispensing device and a container of the kind specified, in such a manner that only a few manipulations, preferably by one hand only, are necessary to insert a container with its content into the sheet dispensing device and to make the sheet dispensing device operative.

According to one aspect of the invention the initial insertion of a container results in, an upward movement of the conveyor and the separator from a lower end position into an upper position and the continued insertion of the container results in a subsequent lowering of the conveyor and the separator into an operative position, in which both rest against the uppermost sheet. These operations are actuated by at least one projection of the container.

Apart from inserting the container the user has nothing to do to bring the conveyor and the separator into their operative positions and to thereby make the sheet dispensing device operative. The user can thus center his entire attention on inserting the container and in doing so easily avoid damaging the uppermost sheet for instance by prints or by an inadmissibly long exposure to light.

The sheet dispensing device according to the invention can be constructed in that at least one lifting device, each, being guided or journalled in the housing is associated with the conveyor and with the separator for the upward movement. The lifting device is actuated by the action of the projection or projections of said container, upon insertion of the container. The lifting device is released as soon as the container has reached an end position in the housing. The action of the projection or of the projections onto the lifting devices can be a direct one or an indirect one via intermediately connected elements. When here and in the following description reference is made to the lifting device for the conveyor, this refers to at least the one lifting device being associated with the conveyor. For reasons of stability it is useful to arrange at each side of the space for the container in the housing of the sheet dispensing device one lifting device, each, for the conveyor and accordingly one lifting device, each, for the separator.

The lifting devices may for instance be guided parallel with respect to each other and movable in upward direction in the housing of the sheet dispensing device. In one embodiment of the invention that is preferred because of the simplicity of construction and trouble-free operation, each of the lifting devices is however pivotally supported on a substantially horizontally and transversely extending transverse axis.

According to another aspect of the invention a rocker is associated to each of the lifting devices. The rocker comprises a ramp extending in the rest position in a direction obliquely to the direction of insertion for causing an upward movement of the associated lifting device upon insertion of the container due to the action thereof. The ramp, however, will yield upon withdrawal of the container from the housing without forcing the associated lifting device to move.

The rocker associated with the lifting device for the conveyor is preferably pivotally supported at the said lifting device and is biased such that its ramp rises in the rest position in a direction opposite to the direction of insertion, namely to the rear, and intersects the path on which the, or a, projection of the container moves upon insertion. The respective projection of the container in this case acts directly on the rocker.

It is furthermore of advantage for the lifting device associated with the conveyor to have a detent for a traverse of the conveyor so that the conveyor cannot be moved forwardly as long as it is supported by the said lifting device and not by the stacks of sheets. In this way incorrect operation of the sheet dispensing device and of the copying machine or the like having been set into operation possibly by the said device, is avoided. Whenever the conveyor cannot be moved forwardly the user at once sees that he has to insert a container with a stack of sheets into the sheet dispensing device, or that a container already having been inserted has not reached its end position.

The traverse is appropriately mounted to a yoke at which at least one roller is journalled adapted to be rolled off on the uppermost sheet upon rearward movement of the conveyor, and locking upon forward movement, whereby the uppermost sheet is displaced.

The construction described in the foregoing can be further improved in that the yoke is supported on a carrier arm so as to be pivotable about a mediam axis arranged parallel with respect to the direction of insertion, approximately in the middle between the lateral guides. A carrier arm is in turn supported so as to be pivotable about a lateral axis extending parallel with respect to the direction of insertion on a conveyor slide being reciprocable along the lateral axis and biased to the rear. This ensures that the, or each, roller rests evenly on the uppermost sheet and consequently upon the forward movement of the conveyor can exert a uniform thrust onto the uppermost sheet; hence there is no danger that the uppermost sheet is turned upon its being moved forwardly.

Furthermore, it is useful for the described lateral axis to project through an opening in the housing upon forward movement of the conveyor and to be provided for operating a copying machine or the like. This correlates readily the actuation of the conveyor and the thereby caused pushing out of the sheet from the sheet dispensing device and the actuation of the device connected downstream. The user can thus for instance initiate a copying operation simply by actuating the conveyor of the sheet dispensing device. It is actually of no importance in what manner the mentioned lateral axis of the sheet dispensing device actuates the device connected downstream; it can act for example on a push button of an electric switch.

The rocker associated with the lifting device for the separator is preferably supported at an abutment slide reciprocable parallel with respect to the direction of insertion and is biased such that its ramp rises in the rest position in the direction of insertion, i.e. in forward direction. The abutment slide is preferably biased in the rearward direction and has an abutment by means of which it is taken along in the forward direction, upon insertion of the container, by the projection thereof. Moreover, the lifting device for the separator is preferably a two-armed lever which supports the separator with its front arm and at its rear arm has a follower member which is pressed down by the ramp upon forward movement of the abutment slide and is again released from the ramp in the end position of the container. This embodiment is particularly useful for a corner separator and ensures that said separator reaches its operative position by an insertion of the container, in which the corners of the separator rest on the front corners of the uppermost sheet.

In the last described embodiment the front arm of the lifting device for the separator is preferably biased downwardly and is connected to the separator only loosely. Thereby it is ensured that said lifting device does not have any influence on the pressure with which the separator rests on the uppermost sheet when the container is completely inserted. This pressure is dependent preferably only on the weight of the separator, in other words the pressure is independent of the height of the stack of sheets.

In all of the embodiments of the sheet dispensing device according to the invention, as described so far, it is useful for the lateral guides in the housing each to have an upper edge along which the projection disposed at the respective side of the container may move. This is, above all, of advantage in case the container is made of carton and its projections are therefore not particularly resistant to bending so that they need to be supported on the upper edges of the guides, in order not to be bent by the elements of the sheet dispensing device with which they cooperate, in particular the rockers.

The projections of the container can principally be arranged at any place at the upper side, at the under side, at one side wall or at both side walls of the container. For the cooperation with the sheet dispensing device according to the invention a container is however particularly useful in which flange-like enlargements of the upper side of the container are provided as projections.

In this case the projections extend preferably alongside of the entire removable portion and alongside of approximately half of the remaining portion of the upper side of the container.

SUMMARY OF THE INVENTION

The sheet dispensing device of the present invention comprises a housing having a pair of guides defining a space therebetween for reception of a container containing a stack of sheets. The container is open at one end as well as at a portion of its upper surface exposing the upper surface of the stack of sheets. A conveyor is adapted to move along the uppermost sheet and a separator is positioned in the housing and adapted to retain all the sheets with the exception of the uppermost sheet engaged by the conveyor upon movement of the same in one direction and the conveyor and the separator are raised and lowered to adjust to the height of the stack of sheets. The conveyor and the separator are moved from a lower end position to an upper position when the container is inserted into the housing and are subsequently lowered into an operative position in which both are supported on the uppermost sheet when the container is completely inserted by control from one projection of the container.

The container is a box-like structure having an upper side, a bottom side, two longitudinal sides, a front end face and a rear face. The front face as well as part of the upper side and of the two longitudinal sides can be removed along a perforated tear line to expose the upper sheet. The upper side or the bottom side of the container also has at least one flange-like projection extending laterally beyond one longitudinal side.

DESCRIPTION OF THE DRAWING

One embodiment of the invention will now be described in more detail with reference to the attached drawing, in which.

DETAILED DESCRIPTION OF THE PREFERRED EMBODIMENT

Figures 1, 7, 8:
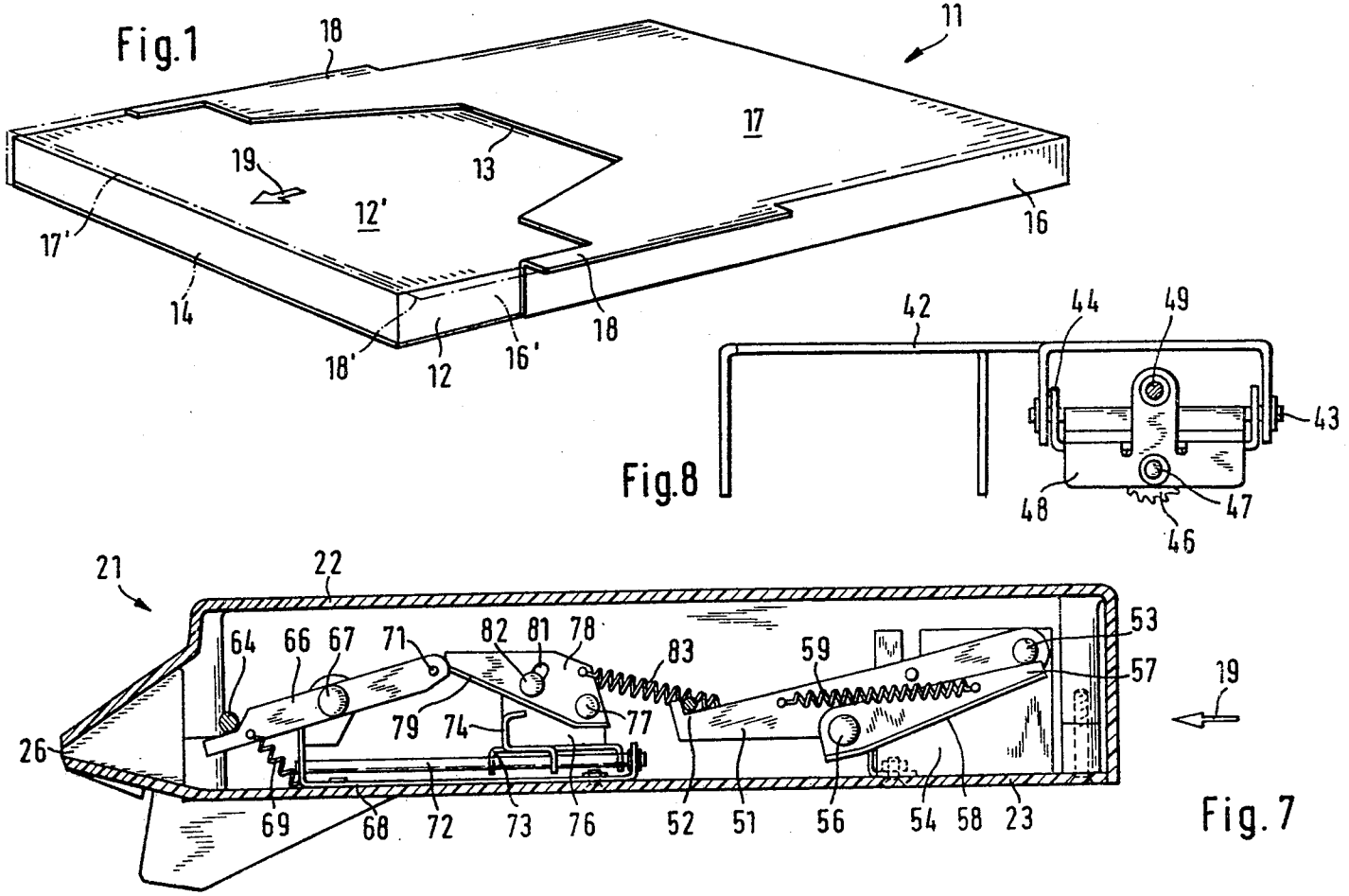
FIG. 1 is a perspective view of a container with a stack of sheets.
FIG. 7 is a vertical section along line VII—VII of FIG. 6.
FIG. 8 is a part view in the direction of the line VIII—VIII of FIG. 6.

FIG. 1 shows a container 11 of carton board containing a stack of sheets 12. The uppermost sheet 12′ of the stack of sheets 12 is partly exposed since the originally completely closed container 11 has been torn open along a prepared tear line 13, whereby its front end face 14 as well as the front part 16′ of its longitudinal sides 16 as well as a front part 17′ of its upper side 17 have been removed. The removed parts are indicated in FIG. 1 by dash-dotted lines. The container 11 has at each of its two longitudinal sides 16 one lateral projection 18. The projection 18 is formed by a flange-like enlargement of the upper side 17. Each of the projections 18 has in the closed condition of the container 11 a front part 18′ which extends from the front end face 14 to the tear line 13 and is removed when the container is torn open. The remaining projections 18 are a little shorter than the region without projections adjacent thereto to the rear, i.e. to the right in FIG. 1.

The container 11 can be inserted into a sheet dispensing device in the direction of arrow 19, the direction being termed in the following as direction of insertion. The sheet dispensing device as illustrated in FIGS. 2 to 8 comprises a housing 21 with a box-shaped upper part 22 and a plate-shaped bottom part 23 screwed to said upper part. On the side of the housing 21 which is the rear one, to the right, in FIGS. 2 to 7, an insertion opening 24 is provided in the upper part 22, the cross section of which is adapted to that of container 11. At the left-hand, front side an outlet slot 26 being funnel-shaped in cross section is provided between the upper part 22 and the bottom part 23, for the respective uppermost sheet 12′ of the stack of sheets 12. At the bottom part 23 which can be molded from plastic by injection, as the upper part 22, lateral guides 27 are formed defining a space 28 for the container. The lateral guides each have an upper edge 29 on which one of the projections 18, of the container 11 may slide along.

Inside the housing 21 a conveyor 31 is accommodated having as stationary elements a folded strip 32 of sheet material, being screwed laterally outside the space 28 to the bottom part 23, and has furthermore two guide rods 33 mounted to said strip 32. The guide rods 33 are disposed vertically in superposed relationship and extend in horizontal direction and parallel with respect to the direction of insertion 19. A conveyor slide 34 is guided on the guide rods 33. The conveyor slide 34 is biased to the rear by a compression spring 36 and has a handle 37 extending outwardly through a longitudinal slot 38 provided in the housing 21 and serving to move the conveyor slide 34 in forward direction.

Vertically above the two guide rods 33 and in parallel to the same a lateral axis 39 is fixed to the conveyor slide 34. The axis 39 extends outwardly in the forward direction through an opening 41 in the upper part 22 of the housing 21 when the conveyor slide is moved forwardly in order to actuate a switch 40 indicated in FIG. 5. The switch 40 is positioned in a circuit of a nonillustrated device to be provided with sheets from the sheet dispensing device and switched on by the lateral axis 39 in its front end position. The switch 40 is preferably installed in the said device. However, the switch 40 can also be mounted to the housing 21 of the sheet dispensing device.

Figure 6:
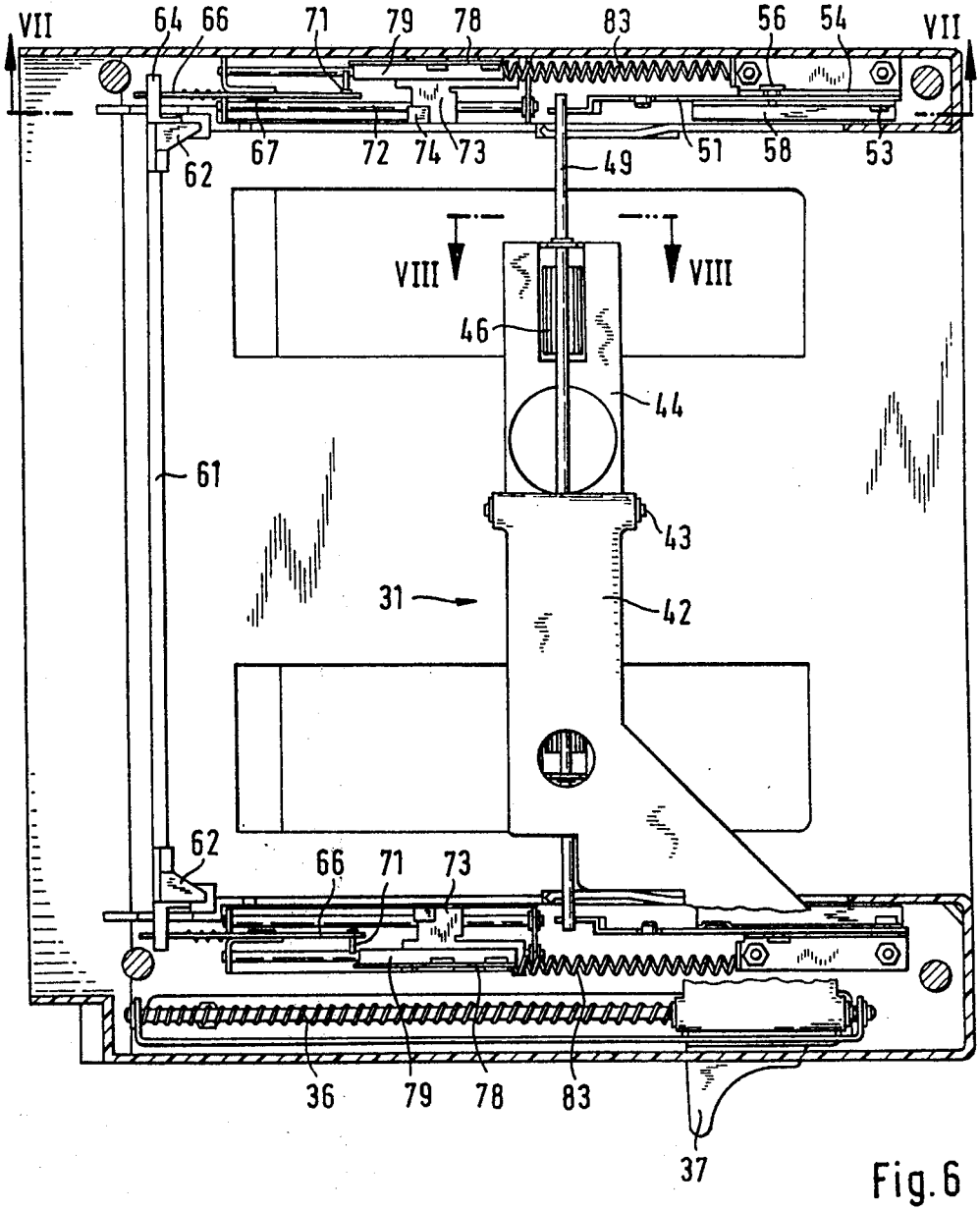
FIG. 6 is a horizontal section through the sheet dispensing device without container.

A carrier arm is pivotally mounted on the lateral axis 39. As shown in FIG. 6 the carrier arm 42 extends up to the middle of the space 28 between the two lateral guides 27 and has there a median axis 43 which extends parallel to the lateral axis 39 and parallel with respect to the direction of insertion 19. On the median axis 43 a yoke 44 is pivotally supported. At the underside of the yoke 44 two rollers 46 are jointly journalled on a common bearing axis 47 such that they can roll off on the uppermost sheet 12′ of the stack of sheets 12 upon rearward movements of the conveyor slide 34 only, but lock upon forward movements and take along the uppermost sheet 12′. In order to enhance this effect the rollers 46 have a saw-toothed profile the steep flanks of which face in the direction of insertion 19. The common bearing axis 47 of the rollers 46 is held in side walls 48 of the yoke 44. A traverse 49 is mounted between the side walls 48 parallel with respect to the bearing axis 47. The traverse 49 extends towards both sides beyond the lateral guides 24.

Figure 2:
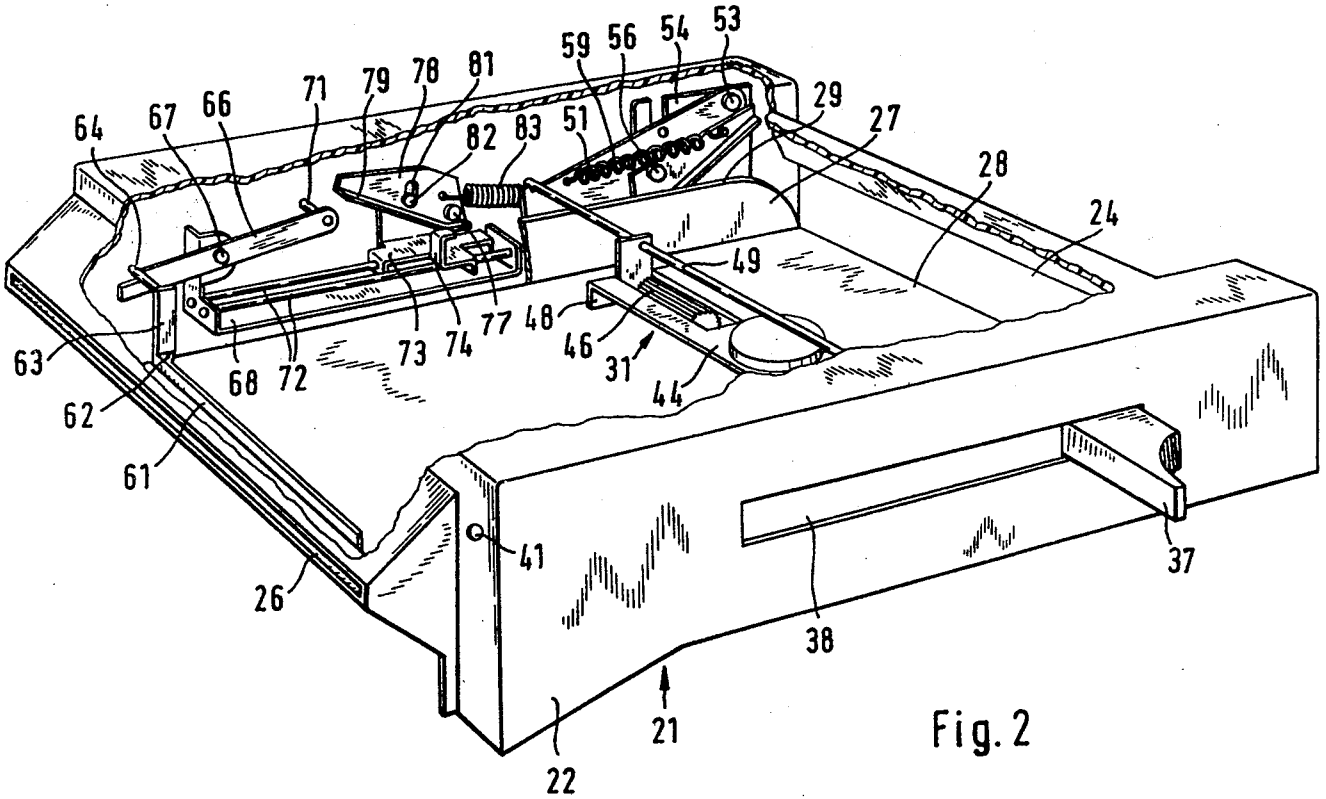
FIG. 2 is a perspective view of a sheet dispensing device before inserting the container.

Outside of each of the two lateral guides 27 is a lifting device 51 having a detent 52 for the traverse 49. Each device 51 is supported pivotally about a transverse axis 53 at a side plate 54. The two side plates 54 consist of folded sheet metal and are in screw connection with the bottom part 23, as illustrated in FIG. 7. The transverse axes 53 are formed by rivets. A rocker 57 is pivotally supported on each lifting device 51 by means of another rivet 56. Each one of the two rockers 57 has a ramp 58 formed by canting which commences in the rest position as illustrated in FIGS. 2 and 7, at a point below the upper edge 29 of the adjacent lateral guide 27 and rises from there obliquely in a direction opposite to the direction of insertion 19, i.e. to the rear. Each rocker 57 is connected with the associated lifting device 51 by means of a spring 59 tending to maintain the said rising of the ramp 58, in other words preventing a swivelling down of the rocker 57 about the rivet 56.

In the front region of the housing 21 a separator 61 in the form of a horizontal beam is slidably guided in a vertical plane. The separator 61 has two corners 62 disposed in a common horizontal plane, as well as two side parts 63 each having a laterally outwardly extending projection 64. Two lifting devices 66 are associated with the separator 61. The devices 66 are supported outside of the space 28 for the container 11 so as to be pivotable about a horizontal transverse axis 67 supported by a canted sheet metal element 68 which is screwed to the bottom part 23. Each one of the two lifting devices 66 is designed as a two-armed lever and grips with its front arm below the associated lateral projection 64 of the separator 61. The front arm of each lifting device 66 is connected to the sheet metal element 63 by means of a spring 69 and is thereby biased in downward direction. The rear arm of each lifting device 66 has a follower member 71 formed in the illustrated embodiment by a pin projecting laterally outwardly.

Two guide rods 72 extending parallel with respect to the direction of insertion are mounted side-by-side in each of the two sheet metal elements 68. An abutment slide 73 is slidably guided on each pair of guide rods 72. Each one of the two abutment slides 73 has on its inner side facing the space 28 an upwardly projecting, hook-shaped abutment 74 extending transversly to the direction of insertion 19, and has furthermore at its outer side an upwardly extending side plate 76, parallel to the direction of insertion 19. A rocker 78 is pivotally supported at the side plate 76 of each abutment slide 73 by means of a horizontal rivet 77 extending transversely to the direction of insertion 19. Each of these rockers 78 has a ramp 79 at its lower edge formed by folding which rises in the direction of insertion 19, i.e. in forward direction, when the rocker is in the rest position. Each rocker 78 has an elongated hole 81 to limit its pivotal range, which hole extends along a circular arc about rivet 77 and receives an additional rivet 82 mounted to the side plate 76. Above the rivet 77, one end of a tension spring 83 is attached to each rocker 78, the other end of the spring being attached to the side plate 54 of the associate lifting device 51. The two tension springs 83 tend on the one hand to maintain the two rockers 78 in the position as illustrated above all in FIGS. 2 and 7, in which the front end of the associated ramp 79 is disposed higher than the follower member 71 of the associated lifting device 66. On the other hand, each of the tension springs 83 tends to keep the abutment slide 73 associated thereto in its rear end position which is also illustrated in FIGS. 2 and 7.

In order to make the sheet dispensing device operative the container 11, torn open as illustrated in FIG. 1, is moved through the insertion opening 24 into the housing 21, in the direction of insertion 19. The two projections 18 slide on the upper edges 29 of the lateral guides 27 while the front edges of said projections are pushed from below against the ramps 58 thus actuating the lifting devices, and upon a continued insertion movement of the container 11 press the rockers 57 together with the lifting devices 51 upwardly.

Figure 3:
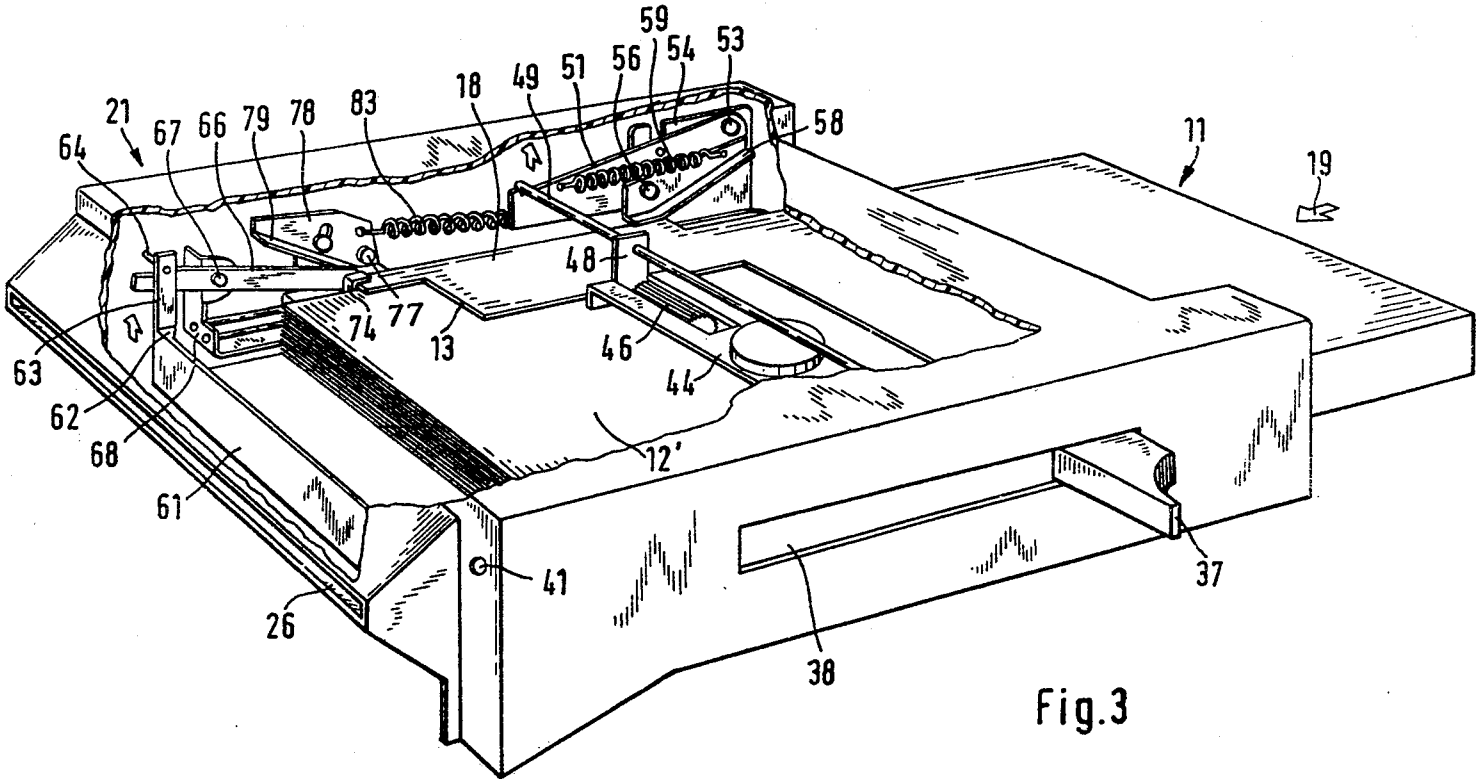
FIG. 3 is a perspective view of the sheet dispensing device with the container being partly inserted.

The lifting devices 51 lift the traverse 49 together with the yoke 44 and the carrier arm 42 of the conveyor 31 from the lower end position, illustrated in FIG. 2 into an upper end position, as illustrated in FIG. 3. Consequently, the entire space 28 between the lateral guides 27 is made free for further insertion movement of the container 11 containing a stack of sheets 12.

Figure 4:
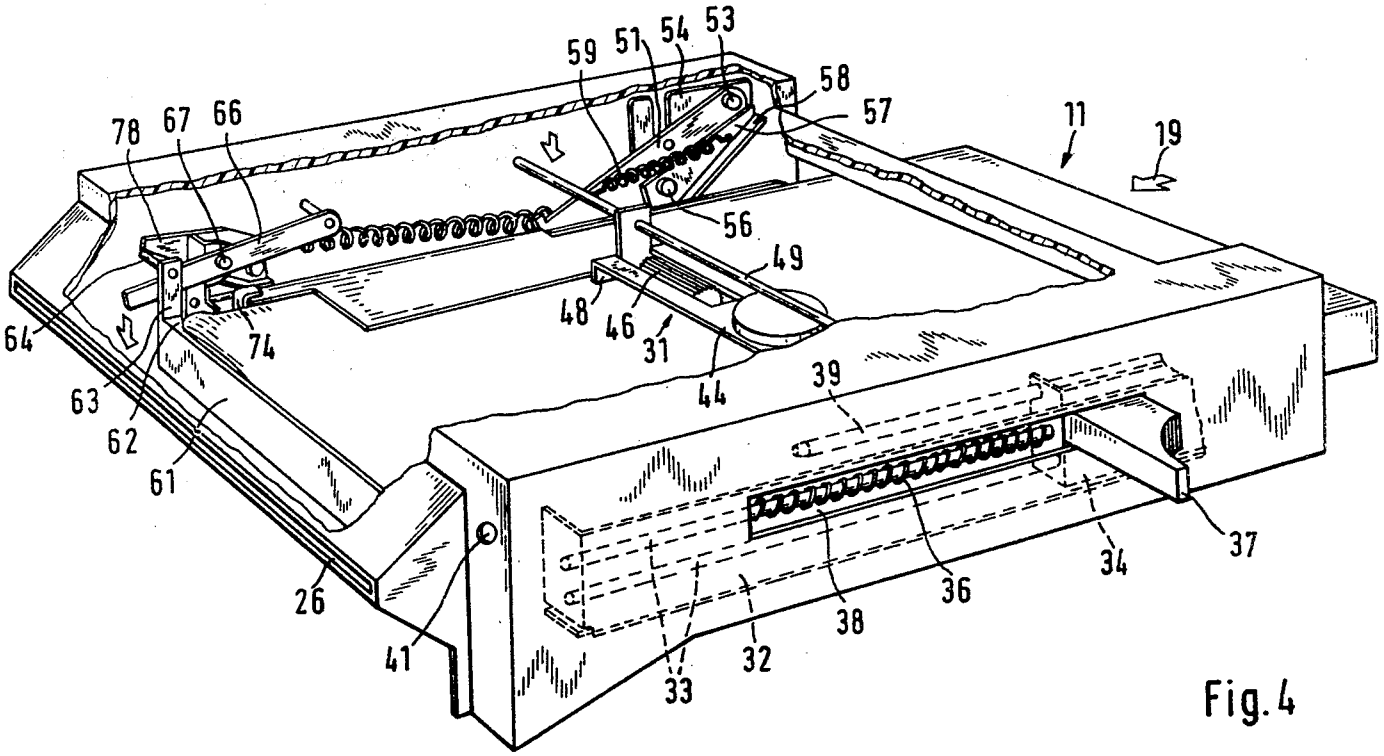
FIG. 4 is a perspective view of the sheet dispensing device with a container inserted up to an end position.
Figure 5:
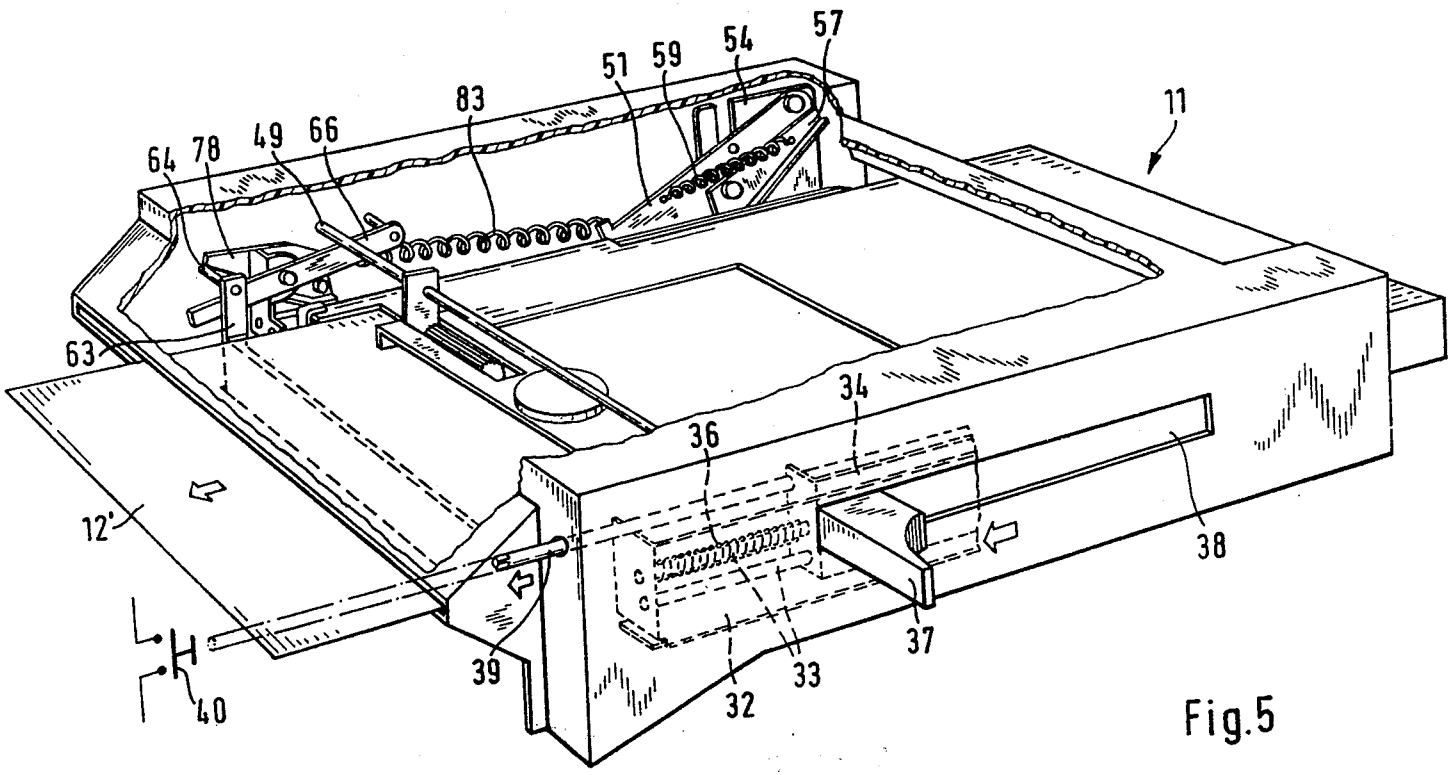
FIG. 5 is a perspective view corresponding to that of FIG. 4 of the sheet dispensing device and the container upon pushing the uppermost sheet forwardly.

During the insertion movement of the container 11 the lateral projections 18 thereof abut with their front edges against one of the hook-shaped abutments 74 such that the container 11 takes along the abutment slides 73 upon a further insertion movement. The ramps 79 of the rockers 78 slide onto the follower members 71 and press them downwardly. As a result, the front arms of the lifting devices 66 are pivoted upwardly and via the lateral abutments 64 take along the separator 61 from its lower end position illustrated in FIG. 2, into its upper end position illustrated in FIG. 3. In the meantime the lateral projections 18 move away from below the rockers 57 so that the lifting devices 51 pivot downwardly again due to their weight and the weight of the conveyer 31. The carrier arm 42 together with the parts of the conveyor 31 that are mounted to it partakes in the downward movement of the lifting devices 51 until the rollers rest on the uppermost sheet 12'. The lifting devices 51 pivot downwardly still further so that they release the traverse 49, as illustrated in FIG. 4. Therefore, the force exerted upon the uppermost sheet by the conveyor 31 is dependent only upon the weight of the parts associated therewith. This force is independent of the lifting device 51.

In the front end position of the abutment slides 73, the follower members 71 reach the rear ends of the ramps 79, in other words, they are no longer pressed downwardly. Thereby separator 61 is released and is lowered due to its own weight to a point until its two corners 62 rest on the two front corners of the uppermost sheet 12' as illustrated in FIG. 4. The separator 61 thereby exerts a force equal to its own weight, on the uppermost sheet. This force is independent of the lifting device 51 and the conveyor 31.

The sheet dispensing device is now operative. The handle 37 is moved in forward direction each time a sheet is needed and the rollers 6 which cannot rotate in forward direction exert a thrust onto the uppermost sheet 12'. At the beginning of the forward movement the separator 61 retains the front edge of the uppermost sheet 12' so that the same is bent upwardly in its front region in which the upper side 17 of the container 11 is torn open across the entire width, and finally jumps over the corners 62. When the handle 67 is moved further in forward direction the uppermost sheet 12' leaves the outlet slot 26. At the same time, or shortly thereafter, the front part of the lateral axis 39 passes through the opening 41 outwardly in order to actuate a switch 40 of a copying machine, or the like, so that this machine can draw inside the sheet 12' in a per se known manner and process it for instance by exposure.

As soon as the handle 37 is released the conveyor 31 returns into its starting position, as illustrated in FIG. 4, and is prepared to move out the next following upper sheet when the handle 37 is again operated.

When the stack of sheets has been used up the empty container is withdrawn to the rear. Simultaneously the lateral projections 18 of the container 11 slide onto the ramps 58 from above and press the rockers 57 downwardly thus overcoming the action of the springs 59 acting on the same.

I claim:

1. A sheet dispensing device for dispensing sheets from a container exposing the upper sheet in a stack, comprising spaced lateral guides inside a housing defining a space for receiving the container, conveyor means for advancing the uppermost sheet, a separator adapted to retain all the sheets with the exception of the uppermost sheet, means supporting said conveyor means and said separator for them to be raised and lowered for adaptation to the height of the stack of sheets and for affording the forward movement of said conveyor, and means for lifting the conveyor means and the separator upon insertion of the container along said guides, said lifting means comprising at least one lifting device supported in said housing which is actuated by the insertion of the container into said space and released as soon as the container has reached an end position in said housing, whereby upon being released, said conveyor means and said separator fall downward against the uppermost sheet and exert a force against the uppermost sheet which is independent of each other and of the lifting device.

2. The sheet dispensing device as claimed in claim 1 wherein said lifting device is pivotally supported on a transverse axis extending substantially horizontally and transversely to the direction of insertion of a said container.

3. The sheet dispensing device as claimed in claim 1 wherein said lifting device comprises a rocker having a ramp extending, when in the rest position, in a direction obliquely to the direction of insertion of a said container, which ramp causes an upward movement of the associated lifting device upon insertion of the container due to the action thereof, and which ramp upon withdrawal of the container from the housing without forcing the associated lifting device to move.

4. The sheet dispensing device as claimed in claim 3 wherein said rocker associated with the lifting device for the conveyor means is pivotally supported at the said lifting device and is biased such that its ramp rises from the rest position in a direction opposite to the direction of insertion of a said container, namely to the rear, and intersects the path on which a said projection of the container moves upon insertion.

5. The sheet dispensing device as claimed in claim 1 wherein said lifting device for the conveyor means has detent means for a traverse of the conveyor means so that the conveyor cannot be moved forwardly as long as it is supported by the said lifting device and not by the stack of sheets.

6. The sheet dispensing device as claimed in claim 5 wherein said traverse is mounted to a yoke on which at least one roller is journalled and adapted to be rolled off on the uppermost sheet upon rearward movement of the conveyor means and locking upon forward movement, whereby the uppermost sheet is displaced.

7. A sheet dispensing device for dispensing sheets from a container exposing the upper sheet in a stack, comprising spaced lateral guides inside a housing defining a space for receiving the container, conveyor means for advancing the uppermost sheet, a separator adapted to retain all the sheets with the exception of the uppermost sheet, means supporting said conveyor means and said separator for them to be raised and lowered for adaptation to the height of the stack of sheets, and means for lifting the conveyor means and the separator upon insertion of the container along said guides, said lifting means comprising at least one lifting device supported in said housing which is actuated by inserting the container into said space and released as soon as the container has reached an end position in said housing whereby upon being released, said conveyor means and said separator fall down against the uppermost sheet and exert a force against the uppermost sheet which is independent of each other and of the lifting device, said lifting device for the conveyor including detent means for a traverse of the conveyor means so that the conveyor means cannot be moved forwardly as long as it is supported by the said lifting device and not by the stack of sheets, and wherein said traverse is mounted to a yoke supported on a carrier arm and pivotable about a median axis arranged parallel with respect to the direction of insertion, approximately in the middle between said lateral guides, said carrier arm in turn being supported so as to be pivotable about a lateral axis extending parallel with respect to the direction of insertion on a conveyor slide being reciprocable alongside the lateral axis and biased to the rear, at least one roller journalled on said yoke and adapted to be rolled off on the uppermost sheet upon rearward movement of the conveyor and locking upon forward movement, whereby the uppermost sheet is displaced.

8. The sheet dispensing device as claimed in claim 7 wherein a handle is provided at said conveyor slide for advancing the same, said handle extending outwardly through a longitudinal slot in said housing.

9. The sheet dispensing device as claimed in claim 8 wherein said lateral axis projects through an opening in the housing upon forward movement of the conveyor means and is provided for operating a switch for a machine.

10. A sheet dispensing device for dispensing sheets from a container exposing the upper sheet in a stack, comprising spaced lateral guides inside a housing defining a space for receiving the container, conveyor means for advancing the uppermost sheet, a separator adapted to retain all the sheets with the exception of the uppermost sheet, means supporting said conveyor means and said separator for them to be raised and lowered for adaptation to the height of the stack of sheets, and means for lifting the conveyor means and the separator upon insertion of the container along said guides, said lifting means comprising at least one lifting device supported in said housing which is actuated by inserting the container into said space and released as soon as the container has reached an end position in said housing, whereby upon being released, said conveyor means and said separator fall down against the uppermost sheet and exert a force against the uppermost sheet which is independent of each other and of the lifting device, and wherein said lifting device comprises a rocker having a ramp, when in the rest position, extending in a direction obliquely to the direction of insertion of a said container, which ramp causes an upward movement of the associated lifting device upon insertion of the container due to the action thereof, and which ramp yields upon withdrawal of the container from the housing without forcing the associated lifting device to move, said rocker being pivotally supported at the said lifting device and biased such that said ramp rises when in the rest position, in a direction opposite to the direction of insertion of a said container, namely to the rear, and intersects the path on which a projection of the container moves upon insertion; and wherein a second rocker is associated with the lifting device for raising the separator and is pivotally supported at an abutment slide reciprocable parallel with respect to the direction of insertion, and is biased such that a ramp thereon rises in the direction of insertion, i.e. in forward direction, and that said abutment slide is biased in the rearward direction and has an abutment by means of which it is taken along the forward direction, upon insertion of a said container, and that said lifting device for the separator is a two-armed lever which supports with its front arm the separator and has at its rear arm a follower member which is pressed down by the ramp upon forward movement of said abutment slide, and is again released from the ramp when the container reaches said end position in the housing.

11. The sheet dispensing device as claimed in claim 10 wherein the front arm of said lifting device for the separator is biased downwardly and is connected to the separator only loosely.

12. The sheet dispensing device as claimed in claim 1 wherein said lateral guides in the housing have an upper edge along which a projection, disposed at and projecting beyond a longitudinal side of the container, may move.

13. A sheet dispensing system including a device for receiving and dispensing sheets seriatim from a container exposing the upper sheet in a stack, said container comprising an upper and a lower cover face parallel to the sheets in a stack of sheets, two longitudinal sides joining said upper and lower faces, one of said cover faces having a flange-like projection extending laterally beyond at least one longitudinal side, a front and a rear face, said front face and part of said upper cover face being removable along a parting line in said longitudinal sides and in said upper cover face, and adapted for the removal along said line of a portion of said container, and said device comprising a housing, spaced lateral guides engaged by said flange-like projections inside said housing defining a space for receiving a said container, conveyor means for advancing the uppermost sheet, a separator adapted to retain all the sheets with the exception of the uppermost sheet, means supporting said conveyor and separator for them to be raised and lowered for adaptation to the height of the stack of sheets, and means for lifting the conveyor and the separator upon insertion of said projections of said container along said guides, said lifting means comprising at least one lifting device supported in said housing, said lifting device being operable when engaged by said projections upon inserting the container into said space and being released again as soon as the container has reached an end position in said housing.

* * * * *